United States Patent [19]

Cedar et al.

[11] 3,962,380

[45] June 8, 1976

[54] CARBURETOR WITH COMBINED CHOKE PULLDOWN AND FAST IDLE CAM KICKDOWN APPARATUS

[75] Inventors: Raymond J. Cedar, Dearborn; Rodney R. Deyo, Westland, both of Mich.

[73] Assignee: Ford Motor Company, Dearborn, Mich.

[22] Filed: Oct. 14, 1975

[21] Appl. No.: 622,332

[52] U.S. Cl. ..... 261/39 B; 261/52; 123/119 F

[51] Int. Cl.[2] ..... F02M 1/10

[58] Field of Search ..... 261/39 A, 39 B, 52; 123/119 F

[56] References Cited

UNITED STATES PATENTS

| | | | |
|---|---|---|---|
| 3,740,040 | 6/1973 | Stoltman et al. | 261/52 |
| 3,848,857 | 11/1974 | Memesson | 261/39 B |
| 3,872,847 | 3/1975 | Charron et al. | 261/39 B |
| 3,886,241 | 5/1975 | Schubeck | 261/52 |
| 3,906,911 | 9/1975 | Nakada | 261/52 |

*Primary Examiner*—Tim R. Miles

*Attorney, Agent, or Firm*—Robert E. McCollum; Keith L. Zerschling

[57] ABSTRACT

A carburetor has a cold engine fuel enrichment apparatus including a single vacuum servo to progressively first crack open the choke valve a predetermined amount once the engine has attained a running condition, to lean the air/fuel mixture, and then pull the fast idle cam off the high cam step, to decrease the mixture flow to the engine, the apparatus including a slide rail cam connected to the servo and progressively engagable with cam follower surfaces on the choke valve operating linkage and the fast idle cam to accomplish the above-desired functions in an automatic manner.

9 Claims, 13 Drawing Figures

CARBURETOR WITH COMBINED CHOKE PULLDOWN AND FAST IDLE CAM KICKDOWN APPARATUS

This invention relates in general to a motor vehicle type carburetor having a choke valve and a fast idle cam. More particularly, it relates to a construction for automatically and successively opening the choke valve from an engine start position and rotating the fast idle cam to move the high cam step out of engagement with the throttle valve stop.

Most conventional carburetors have an automatic choke system for restricting air intake to richen the carburetor air/fuel mixture during cold engine operation to maintain good engine driveability. Also, in most instances, a fast idle cam that is operably rotated by a thermostatically responsive coiled spring is positioned in the path of closing movement of the throttle valve to maintain it more open than the normal engine idle speed position to allow enough extra fuel/air mixture into the engine to sustain cold engine operation. The thermostatic spring also urges the choke valve towards a closed position for engine starting, and immediately after the engine has reached a sustained operation, a pulldown servo cracks open the choke valve to a position leaning the air/fuel mixture to prevent rich mixture stalling.

In the above construction, an adjustable screw secured to the throttle valve rotates into frictional engagement with a high cam step on the fast idle cam to determine the cold engine idle speed position of the throttle valve. Until the vehicle operator, therefore, manually opens the throttle valve to release the cam, it cannot move from its position because of the frictional resistance. Therefore, the throttle valve will remain in a fast idle position with a higher than required engine speed as the engine begins to warm up. The normal procedure then is for the operator to depress the accelerator pedal to back off the idle screw from the fast idle cam face and permit the cam to fall by gravity to whatever position is dictated by the particular temperature conditions. Subsequent release of the accelerator pedal then will reengage the fast idle screw with a lower step face of the cam and permit a closing down of the throttle valve.

It is known to provide one vacuum servo to open the choke valve, and then another separate servo to pull the fast idle cam off the high cam step and open the choke valve wider. However, this is a very uneconomical and cumbersome way to accomplish the result besides requiring a number of separate, independently operable parts requiring multiple assembly operations.

It is a primary object of the invention, therefore, to provide single vacuum mechanical apparatus to automatically and progressively first crack open the choke valve an initial amount from a closed throttle engine start position to lean the air/fuel mixture to a level more agreeable with engine requirements, and then rotate the fast idle cam off its high cam step engagement with the throttle valve screw to decrease mixture flow and lower engine speed to a level more consistent with the engine operational requirements.

It is a further object of the invention to provide a carburetor of the type described above with a vacuum servo actuated linkage mechanism actuated by engine intake manifold vacuum and connected to a sliding cam rail with projections to first rotate a camming member against a choke valve lever to open the choke, and then to rotate the fast idle cam so that the high cam step will be moved out of engagement with the throttle valve idle adjustment screw and a second lower cam step of less radial extent rotated into engagement with the idle adjustment screw.

Other objects, features and advantages of the invention will become more apparent upon reference to the succeeding detailed description thereof, and to the drawings illustrating the preferred embodiment thereof, wherein.

Figure 1:
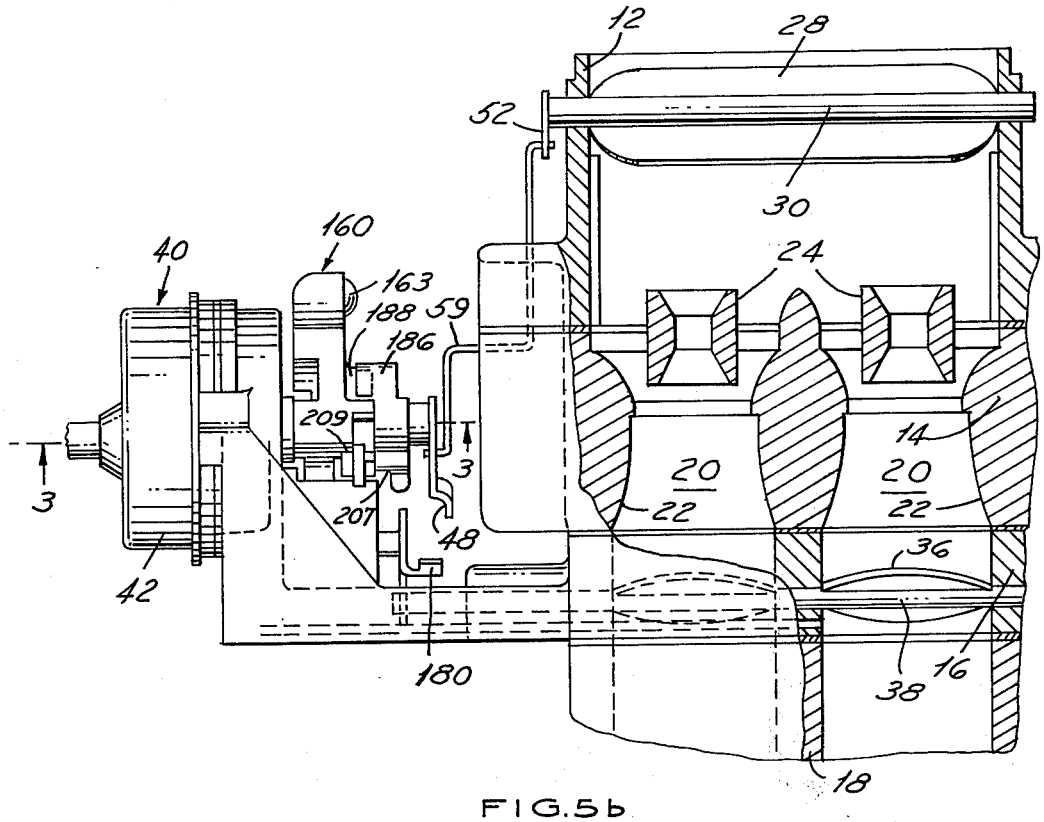
FIG. 1 is a partial cross-sectional view of a portion of a carburetor embodying the invention.
Figure 5B:
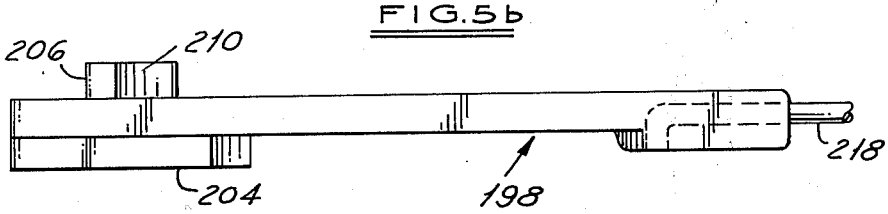
Figure 5A:
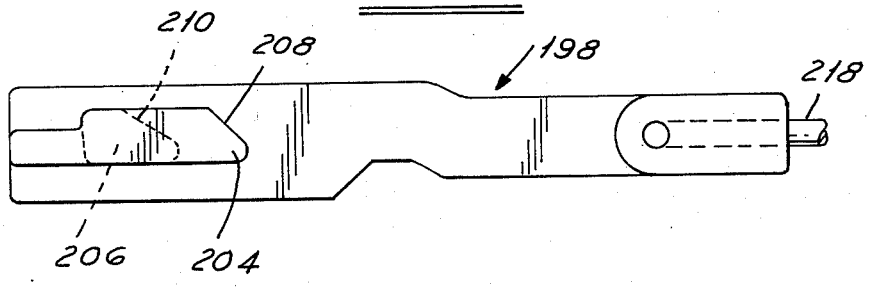
Figures 4, 4A, 4B, 4C:
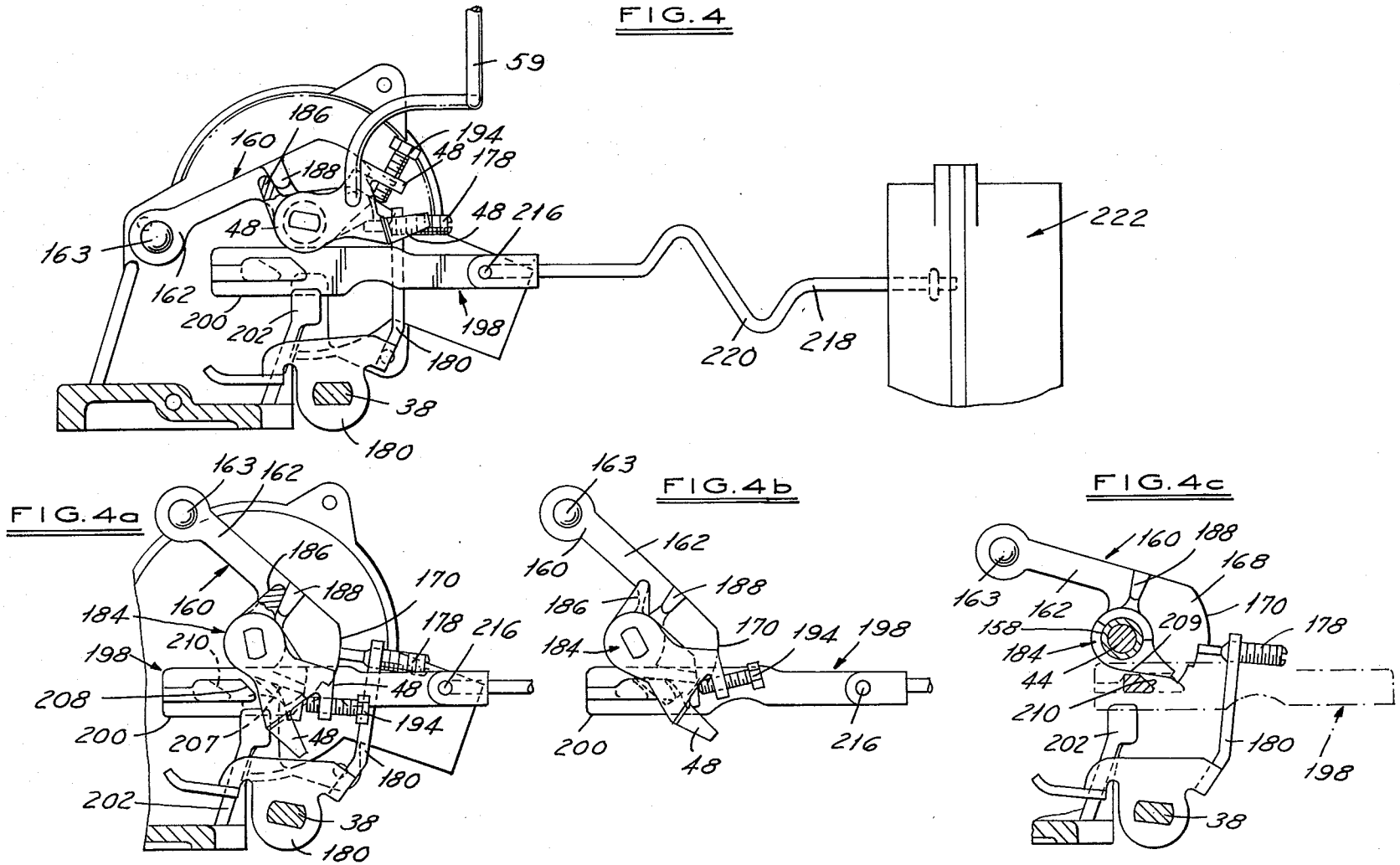
FIG. 4 is a side elevational view, on a reduced scale, viewed in the direction of the arrows 4—4 of FIG. 2.

FIGS. 4*a*, 4*b*, and 4*c* are views corresponding to FIG. 4, illustrating parts thereof in different operative positions; and, FIGS. 5*a*, 5*b*, 6*a*, 6*b* and 7*a*, 7*b* are side elevational and top views, respectively, of details shown in FIG. 1.

FIG. 1 is obtained by passing a plane through approximately one-half of a known type of two-barrel, downdraft carburetor. It includes an air horn section 12, a main body portion 14, and a throttle body 16 secured together by suitable means, not shown, over an intake manifold indicated partially at 18 leading to the engine combustion chambers.

Main body portion 14 contains the usual air/fuel mixture induction passages 20 having fresh air intakes at the air horn ends, and connected to manifold 18 at the opposite ends. The passages are each formed with a main venturi 22 in which is suitably mounted a boost venturi 24.

Air flow into passages 20 is controlled by a choke valve 28 that is unbalance mounted on a shaft 30. The shaft is rotatably mounted in side portions of the carburetor air horn, as shown. Flow of the usual fuel and air mixture through each passage 20 is controlled by a conventional throttle valve 36 fixed on a shaft 38 rotatably mounted in the throttle body 16. The throttle valves are rotated in the usual manner by depression of the vehicle accelerator pedal, and move from idle speed or closed positions to positions essentially at right angles to that shown.

Figure 3:
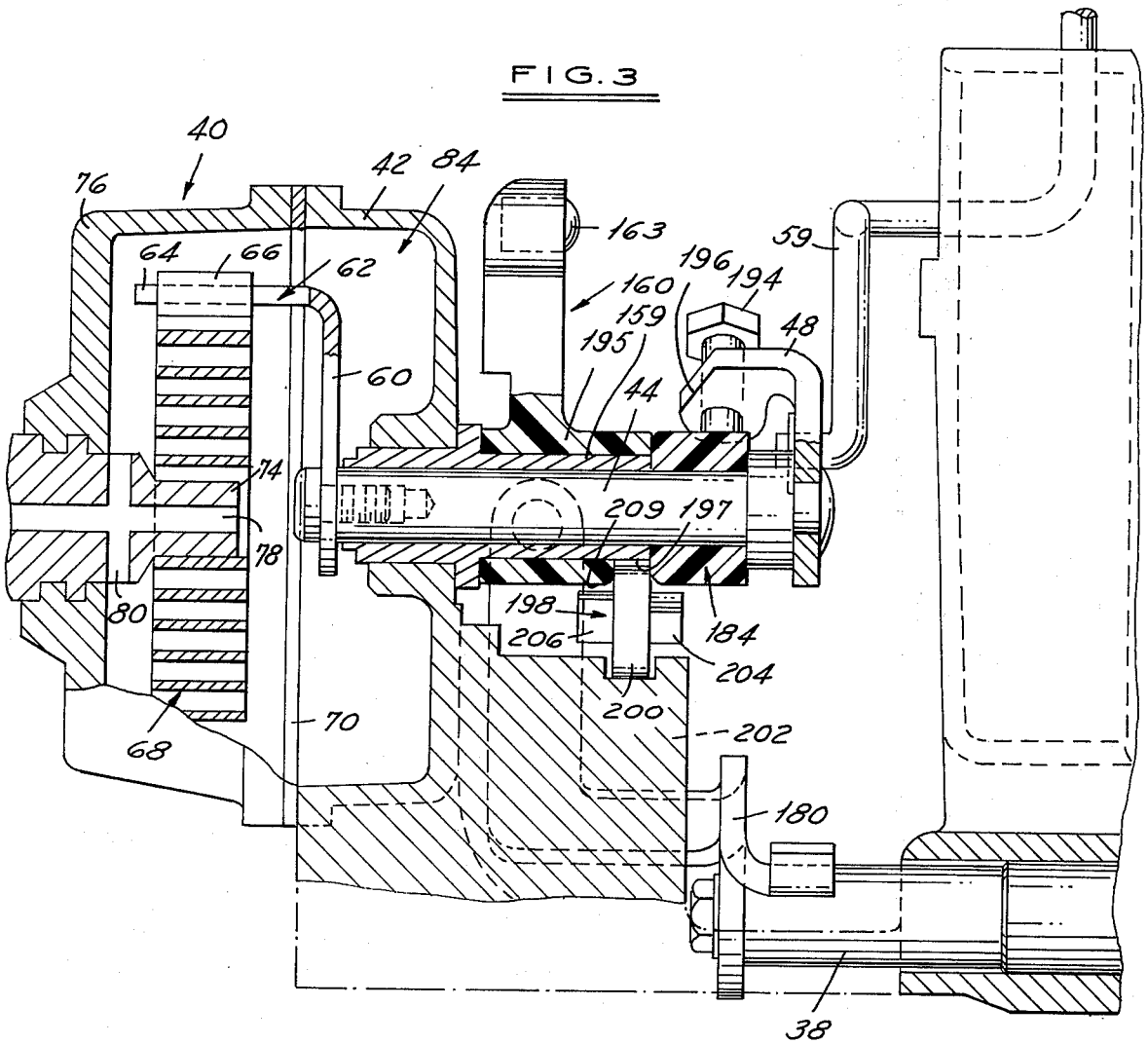
FIG. 3 is an enlarged cross sectional view taken on a plane indicated by and viewed in the direction of the arrows 3—3 of FIG. 1.

Choke valve 28 rotates from a closed position to the nearly vertical, essentially inoperative position shown, providing the minimum obstruction to airflow. The rotative position of choke valve 28 is controlled in part by a semiautomatically operating choke mechanism 40 shown more clearly in FIG. 3. The latter includes a hollow housing portion 42 that is cast as an integral extension of the carburetor throttle body 16. The housing is apertured for rotatably supporting one end of a choke valve control shaft 44. A bellcrank-type lever 48 fixed on the opposite end portion of shaft 44 is pivotally connected by a link 59 to a lever 52 fixed on choke valve shaft 30. It will be clear that rotation of shaft 44 in either direction as seen in FIG. 3 will rotate choke valve 28 in a corresponding direction to open or close the carburetor air intake, as the case may be.

The end of shaft 44 in housing 42 has fixed on it one leg 60 of an essentially L-shaped thermostatic spring lever 62. The other lever leg portion 64 is secured to the end 66 of a thermostatically responsive, bimetallic, coiled spring element 68 through an arcuate slot, not shown, in an insulating gasket 70. The inner end portion of the coiled spring is fixedly secured on the end of a nipple 74 formed as an integral portion of a choke cap 76 of heat insulating material. Nipple 74 is bored as shown to provide hot air passages 78 and 80 connected to an exhaust manifold heat stove, for example, by a tube 81 shown in FIG. 2. Cap 76 is secured to housing 42 by suitable means, such as the screw 82 shown, and defines an air or fluid chamber 84.

As thus far described, it will be clear that the thermostatic spring element 68 will contract or expand as a function of changes in temperature of the air entering tube 81, or, if there is no flow, the ambient temperature of the air within chamber 84. Accordingly, changes in temperature will rotate the spring lever 62 to rotate shaft 44, lever 48, and choke valve 28 in one or the other directions, as the case may be.

Although not shown, chamber 84 would be connected by a passage to one of the carburetor main induction passages 20 by a port located just slightly below throttle valve 36 so that the chamber would, therefore, always be subject to the vacuum existing in the intake manifold passage portion 18. This causes the flow of hot air from tube 81 through the chamber 84.

The start of a cold engine requires a richer mixture than that of a warmed engine because less fuel is vaporized. Therefore, the choke valve must be shut or nearly shut to restrict air flow and increase the pressure drop across the fuel inlet to draw in more fuel and less air. The choke mechanism described above automatically accomplishes this action.

Figure 6A:
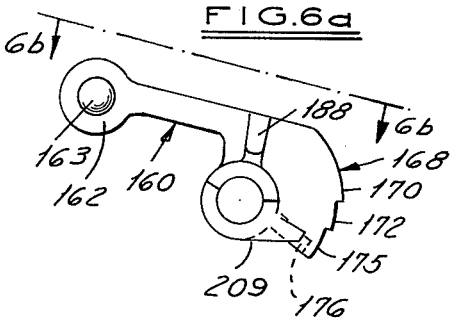
Figure 6B:
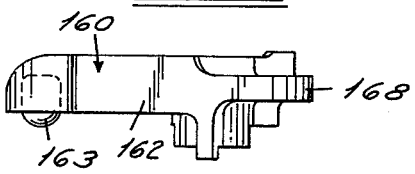

During cold engine operation, it is also necessary to open the throttle valve wider to allow enough extra air/fuel mixture into the engine to prevent it from stalling due to the extra friction, greater viscosity of the lubricant, etc. For this purpose, rotatably mounted on a sleeve bearing 159 supporting shaft 44 is an essentially conventional fast idle cam 160. As best seen in FIGS. 6a and 6b, the cam has a finger-like projection 162 on one side that contains a recess in which is pressed a weight or ball 163 of predetermined mass. The mass and its location is chosen such that the cam will always fall by gravity in a counterclockwise direction, towards the position shown in FIG. 4.

Figure 2:
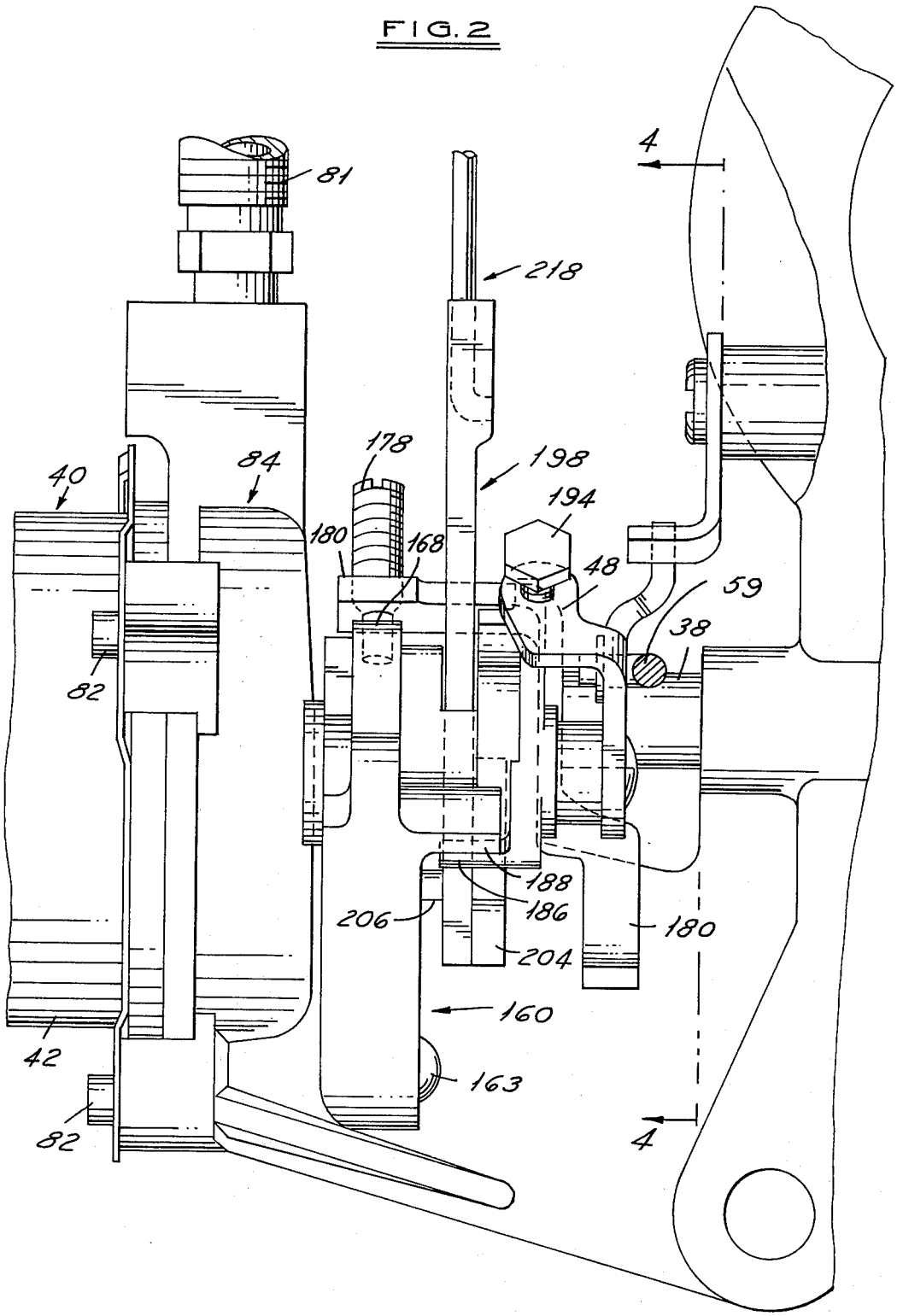
FIG. 2 is an enlarged top view of a portion of the carburetor shown in FIG. 1.

The opposite side of cam 160 is formed with an arcuate edge 168 having a number of circumferentially contiguous steps, including a high cam step 170, and a lower cam step 172. Each step in clockwise circumferential succession is defined by a face that is of less radial extent than the previous one, the lowest step 175 being followed by an offset or opening 176. The steps and opening constitute abutments or stops in the path of movement of a screw 178 (FIGS. 2 and 4). The screw is adjustably mounted on a lever 180 fixed on throttle shaft 38. The radial depth of opening 176 is chosen such that when the fast idle cam 160 is rotated to engage the screw 178 in the opening 176, the throttle valve shaft will have rotated the throttle valve to its normal engine operating temperature level idle speed position essentially closing the throttle valve. Engagement of the screw 178 with each of the steps 170 and 172 as the cam rotates upon temperature decreases, then will progressively locate the idle speed position of the throttle valve at a more open position.

Figure 7A:
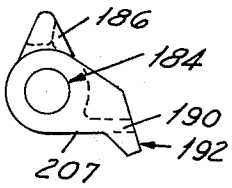
Figure 7B:
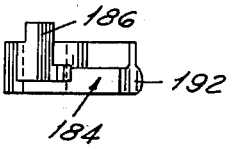

As best seen in FIGS. 1, 2 and 4, and in detail in FIGS. 7*a* and 7*b*, interconnecting the fast idle cam and the choke lever 48 is a bellcrank-shaped cam member 184 rotatably mounted on shaft 44. One leg 186 of cam member 184 is adapted to underlie an axial projection 188 of the fast idle cam to provide a one-way interconnection between the two. The other leg 190 has an edge 192 adapted to be engaged by a screw 194 adjustably mounted on a tab 196 of choke lever 48. This also provides an adjustable one-way connection between choke lever 48 and cam member 184. As a result, the choke lever 48 can rotate freely with respect to cam member 184 in a counterclockwise direction to open the choke valve. On the other hand, cam member 184 can move choke lever 48 in the choke valve opening direction.

Similarly, the fast idle cam is free to rotate in a clockwise direction away from cam member 184, but can be held against movement in the opposite direction upon engagement of the cam projection 188 with the cam member projection 186. The sleeve mounting portion 195 of fast idle cam 160 is cut away at 197 as best seen in FIG. 3 to guidingly receive therein a longitudinally extending cam slide rail 198. The lower portion 200 of the rail rests on a support boss 202 formed integral with the carburetor body casting. As seen more clearly in the side view of FIG. 5*a* and the top view of FIG. 5*b*, the slide rail has a pair of first and second cam surfaces 204 and 206 that project laterally from the longitudinal axis of the rail on opposite sides of the rail. The cam surface 204 is radially aligned with and normally positioned partially beneath and spaced longitudinally from a cam follower surface 207 (FIG. 1) on the cam member 184, while the cam surface 206 is radially aligned with and normally positioned partially beneath and spaced longitudinally of a cam follower surface 209 on the fast idle cam 160. Both surfaces 204 and 206 contain projecting camming ramps 208 and 210 which when engaged with the bottom cam follower surfaces of the respective cam member and cam, upon rightward movement, as seen in FIG. 4, of the rail 198, effect a rotation of the cam and cam member.

The ramp surfaces 208 and 210 are spaced longitudinally on rail 198 in such a manner that longitudinal movement of the rail rightwardly will, as seen in FIG. 4*a*, first engage ramp 208 with the cam follower surface 207 and rotate cam member 184 counterclockwise a predetermined amount, to the FIG. 4b position. This, through screw 194, rotates choke lever 48 in the same direction to open choke valve 30 by the same degree. Continued rightward movement of slide rail 198 then engages the ramp surface 210 with the cam follower surface 209 on fast idle cam 160 to rotate the cam in a counterclockwise direction, as seen in FIG. 4*c* until the high cam step 170 is disengaged from the throttle lever screw 178, and the lower cam step 172 is engaged with it.

The length of the ramps 208 and 210, of course, are prechosen to provide the desired action. First, ramp 208 must be sufficiently long to initially crack open the closed choke valve 30 by a chosen amount required to lean the engine mixture to the desired level immediately after it has reached a sustained operation subsequent to a cold engine cranking. Likewise, the ramp 210 must be of a length sufficient to "pull off" the fast idle cam 160 from its high cam step 170 engagement with the throttle lever abutment screw 178, to reduce overall mixture flow to the engine to reduce engine speed to a level more consistent with engine requirements.

The slide rail 198 is shown in FIG. 4 as having a pivotal connection at 216 to a linkage 218. The yieldable bend 220 in the linkage permits thermal expansion and contraction of the parts. The opposite end of linkage 220 is connected to a conventional vacuum servo 222. Although not shown, the servo could consist of a hollow shell divided into an air chamber and a vacuum chamber by an annular flexible diaphragm, to which is fixed the linkage 218. A spring would lightly bias the diaphragm leftwardly to locate the slide rail cam members 204 and 206 out of contact with the fast idle cam 160 and cam follower surfaces, i.e., to inoperative positions. The vacuum chamber of the servo would be connected by a tube to the engine intake manifold, or to a point in the carburetor below the throttle valve.

In overall operation, below temperature levels of say 75°F., for example, the contraction of bimetallic coiled spring 68 in FIG. 3 will urge choke lever 48 and, therefore, cam member 184 in a clockwise direction towards the position shown in FIG. 4a. Depression of the accelerator pedal will then pivot the throttle valve shaft 38 and lever 180 clockwise to move screw 178 away from the fast idle cam 160. This will permit the cam to be moved clockwise by the projection portion 186 of cam member 184. Release of the accelerator pedal then permits the screw stop 178 to engage high cam step 170 that is opposite the screw at this time. This locates the throttle valve for a fast idle open throttle setting predetermining the total volume of air/fuel mixture to flow into the engine during cold engine operation at this temperature level.

After the engine has been cranked and reached a sustained engine operating level, engine vacuum applied to servo 22 will move slide rail 198. The slide rail at this time is shown in a starting position with the cam actuating ramp surface 208 just engaging the under surface 207 of cam member 184, but ramp surface 210 spaced from the under surface 209 of fast idle cam 160. The rightward progressive movement of the ramp 208, therefore, rotates cam member 184 counterclockwise to the FIG. 4b position, which also rotates choke lever 48 in the same direction to crack open the choke valve 30. The cranking mixture then is leaned to a less rich mixture preventing stalls. Immediately following this operation, continued application of vacuum to servo 222 pulls the slide rail 198 rightwardly to the FIG. **4*c* position, the cam ramp surface 210 rotating fast idle cam 160 counterclockwise. This stroke of link 218 is such that the fast idle cam 160 will rotate far enough counterclockwise as seen in FIG. 4*c* to move the high cam step 170 away from engagement with the throttle lever stop screw 178, and the lower cam step 172 into engagement with the screw. At the same time, the counterclockwise rotation of cam 160 will cause the projection 188 to catch up to the projection portion 186 of cam member 184** to locate the fast idle cam for subsequent control of the engine idle speed as a function of temperature.

Subsequent warming of the engine will, therefore, continue to urge lever 48 and cam member 184 in a counterclockwise direction. Upon depression of the throttle valve, screw 178 will be backed off, and the fast idle cam 160 is permitted to rotate by gravity against the cam member 184. The cam will finally attain the position shown in FIG. 4, allowing the screw 178 to enter the opening 176. This permits the throttle valve to attain a normal engine idle speed position at the normal engine operating temperature level.

Thus, it will be seen that the invention provides a single mechanism that automatically and progressively first cracks open the choke valve from its closed cold engine cranking position to lean the cranking mixture, and then "kicks down" the fast idle cam to a lower cam setting to reduce engine idle speed to a new level more suitable to the engine requirements, thus eliminating the need for multiple servo systems and eliminating the requirement of the driver to to perform the kickdown operation, as conventionally must be done. This, therefore, reduces emission output by providing better control of the combustion than when it is manually controlled, and lessens the emission of undesirable elements by the leaning of the mixture to the proper level.

While the invention has been shown and described in its preferred embodiment, it will be clear to those skilled in the arts to which it pertains that many changes and modifications may be made thereto, without departing from the scope of the invention.

We claim:

1. A carburetor having an air/fuel induction passage open at one end to air at essentially atmospheric pressure and connected at its opposite end to an engine intake manifold to be subject to the changing vacuum levels therein, the one end having a choke valve rotatably mounted for movement across the passage between a closed air choking position and an open inoperative position, and a throttle valve rotatably mounted posterior of the choke valve for movement across the passage between a normal essentially closed engine idle speed position and beyond towards a wide open throttle position to control the quantity of air/fuel mixture flow through the passage, an abutment means rotatable with the throttle valve, a rotatable fast idle cam having a high cam step projecting radially from the cam axes for engagement at times by the abutment means during movement of the throttle valve in a closing direction to stop the throttle valve in a more open position than the idle speed position to increase mixture flow to the manifold, the cam also having a second cam step of lesser radial extent engagable with the abutment means at other times as a function of the rotative position of the cam to stop the throttle valve in a less open position than the high cam step position, the cam being rotatable by gravity towards an inoperative position upon disengagement of the abutment means with the cam step permitting closure of the throttle valve towards the normal idle speed position, rotatable lever means secured to the choke valve, interconnecting means operably connecting the lever means and fast idle cam and having a portion extending into the path of rotative movement of the fast idle cam towards the inoperative position to stop the cam rotation, means to rotate the lever means, and a single vacuum actuated member engagable with the interconnecting means and cam and operable immediately upon the engine attaining sustained operation after the initial cold engine cranking operation while the abutment means is engaged with the fast idle cam high step to automatically and sequentially first effect movement of the lever means to crack open the choke valve from a closed engine cranking position and subsequently rotate the fast idle cam to a position disengaging the abutment means from the high cam step and engaging the abutment means with the second cam step to lean and reduce the mixture flow to the engine to improve emissions while minimizing engine stalling.

2. A carburetor as in claim 1, including a shaft mounting the lever means, means rotatably mounting the fast idle cam and the interconnecting means on the shaft, and a cam member connected to the vacuum actuated member and progressively engagable with the interconnecting means and cam to first operably rotate the lever means to open the choke valve and then rotate the cam off the high cam step engagement with the abutment means.

3. A carburetor as in claim 2, the interconnecting means comprising a bellcrank-like member havine a one-way interconnection with the lever means permitting free movement of the lever means in a choke valve opening direction.

4. A carburetor as in claim 2, the vacuum actuated member comprising a vacuum servo having linkage means connecting the servo and cam member, and a vacuum line connecting the servo to the engine intake manifold vacuum.

5. A carburetor as in claim 2, the cam member comprising an elongated slide member movable laterally of the axis of the shaft and having a pair of first and second spaced laterally projecting cam portions, the first portion being engagable with the interconnecting means to rotate the same, the second portion being engagable with the cam to rotate the cam.

6. A carburetor as in claim 5, the cam portions projecting from opposite sides of the slide member into separate alignment with cam follower portions on the interconnecting means and cam.

7. A carburetor as in claim 3, including means securing the shaft to a thermostatically responsive spring means urging the shaft and lever means in a choke valve closing direction upon decreases in temperature below the engine normal operating temperature level to effect movement of the fast idle cam by the lever means to permit repositioning of the fast idle cam to its high cam step engagement position with the abutment means for engine starting purposes.

8. A carburetor having an air/fuel induction passage open at one end to air at essentially atmospheric pressure and connected at its opposite end to an engine intake manifold to be subject to the changing vacuum levels therein, the one end having a choke valve rotatably mounted for movement across the passage between a closed air choking position and an open inoperative position, and a throttle valve rotatably mounted posterior of the choke valve for movement across the passage between a normal essentially closed engine idle speed position and beyond towards a wide open throttle position to control the quantity of air/fuel mixture flow through the passage, an abutment means rotatable with the throttle valve, a rotatable fast idle cam having a high cam step projecting radially from the cam axes for engagement at times by the abutment means during movement of the throttle valve in a closing direction to stop the throttle valve in a more open position than the normal idle speed position to increase mixture flow to the manifold, the cam also having a second cam step of lesser radial extent engagable with the abutment means at other times as a function of the rotative position of the cam to stop the throttle valve in a less open position than the high cam step position, the cam being rotatable by gravity towards an inoperative position upon disengagement of the abutment means with the cam step permitting closure of the throttle valve towards the normal idle speed position, a shaft, rotatable lever means secured on the shaft for rotation therewith and connected to the choke valve, the shaft rotatably mounting the fast idle cam and a bellcrank cam member, the cam member having axially spaced projecting portions providing separate one-way interconnections with the lever means and fast idle cam permitting free rotation of the lever means in a choke valve opening direction and the fast idle cam in a direction moving the high cam step towards engagement with the abutment means, both the cam member and cam having separate cam follower surfaces, the cam member one-way interconnection with the fast idle cam comprising a portion extending into the path of rotative movement of the fast idle cam towards the inoperative position permitting stopping of rotation of the cam in this direction, thermostatic spring means to rotate the shaft and lever means, and vacuum mechanical control means operable in response to the engine attaining sustained operation after a cold engine cranking operation while the abutment means is engaged with the fast idle cam high step to automatically and progressively first move the lever means to crack open the choke valve from an initial closed position and subsequently rotate the fast idle cam to a position disengaging the abutment means from the high cam step and engaging the abutment means with the second cam step to lean and reduce the mixture flow to the engine to improve emissions while minimizing engine stalling, the control means comprising a vacuum servo, a vacuum line connecting the engine manifold vacuum to the servo, linkage means connected to and actuated by the servo, and a longitudinally extending cam slide rail secured to and movable with the linkage means and positioned adjacent to the cam member follower surface and fast idle cam follower surface, the rail having first and second cam portions projecting laterally from the rail in opposite directions for separate engagement with the cam member cam follower surface and fast idle cam cam follower surface, respectively the first and econd cam portions also being spaced from each other along the lontitudinal extent of the rail to effect the progressive engagement of the slide rail cam portions with the cam member and fast idle cam follower surfaces to effect the above said progressive opening of the choke valve and rotation of the fast idle cam upon supply of vacuum to the servo.

9. A carburetor as in claim 8, including means securing the shaft to a thermostatically responsive spring means urging the shaft and lever means in a choke valve closing direction upon decreases in temperature below the engine normal operating temperature level to abut the cam member portions with the lever means and fast idle cam and permit repositioning of the fast idle cam to a high cam step engagement with the abutment means for engine starting purposes.

* * * * *